US011332298B2

(12) United States Patent
Giraud

(10) Patent No.: US 11,332,298 B2
(45) Date of Patent: May 17, 2022

(54) RESEALABLE MOISTURE TIGHT CONTAINER ASSEMBLY FOR STRIPS AND THE LIKE HAVING A LIP SNAP SEAL

(71) Applicant: CSP TECHNOLOGIES, INC., Auburn, AL (US)

(72) Inventor: Jean-Pierre Giraud, Paris (FR)

(73) Assignee: CSP Technologies, Inc., Auburn, AL (US)

( * ) Notice: Subject to any disclaimer, the term of this patent is extended or adjusted under 35 U.S.C. 154(b) by 0 days.

(21) Appl. No.: 17/645,156

(22) Filed: Dec. 20, 2021

(65) Prior Publication Data

US 2022/0112020 A1 Apr. 14, 2022

Related U.S. Application Data

(63) Continuation of application No. 17/305,210, filed on Jul. 1, 2021, now Pat. No. 11,230,422, which is a (Continued)

(51) Int. Cl.
*B65D 81/26* (2006.01)
*B65D 83/08* (2006.01)
(Continued)

(52) U.S. Cl.
CPC ..... *B65D 81/266* (2013.01); *A61J 1/03* (2013.01); *B65B 5/04* (2013.01); *B65B 7/26* (2013.01);
(Continued)

(58) Field of Classification Search
CPC ..... B65D 81/266; B65D 43/164; A61J 1/03; B65B 7/26
(Continued)

(56) References Cited

U.S. PATENT DOCUMENTS 2,003,355 A 6/1935 Farkas
2,175,673 A 10/1939 Shields
(Continued)

FOREIGN PATENT DOCUMENTS

CA 2428862 A1 11/2004
DE 19546684 A1 6/1997
(Continued)

OTHER PUBLICATIONS

Judgement rendu le Feb. 28, 2013, Demanderesses Societe CSP Technologies, Inc., Defenderesse Societe Airse, SAS, Tribunal de grande instance de Paris, 3eme chambre, 1ere section, No. RG: 11/06900 (Judgement of Feb. 28, 2013, Claimants CSP Technologies, Inc., Defendant Airsec SAS, Paris District Court, 3rd Division, Section 1); 60 pgs.
(Continued)

*Primary Examiner* — Anthony D Stashick
*Assistant Examiner* — Raven Collins
(74) *Attorney, Agent, or Firm* — Mark T. Vogelbacker; Eckert Seamans Cherin & Mellott, LLC

(57) ABSTRACT

A substantially moisture tight container and lid assembly for storing and packaging moisture-sensitive items comprising an assembly with a container and a lid, the lid is attached by a hinge to an upper housing portion of the container, the lid includes a lip seal member that depends downwardly from the lid, the lip seal member is configured to abut at least a portion of the interior side of the container when the lid is in the closed position resulting in a substantially moisture tight seal between the lid and the lid, and the container assembly further comprising a base portion and an upper housing portion, the upper housing portion is capable of being snap-fit into the base portion by employing a lip seal mechanism to form a substantially moisture-tight seal.

8 Claims, 10 Drawing Sheets

Related U.S. Application Data continuation of application No. 15/476,489, filed on Mar. 31, 2017, now Pat. No. 11,053,060, which is a continuation of application No. 14/202,867, filed on Mar. 10, 2014, now Pat. No. 9,650,181, which is a continuation of application No. 13/944,708, filed on Jul. 17, 2013, now abandoned, which is a continuation of application No. 13/533,233, filed on Jun. 26, 2012, now Pat. No. 8,528,778, which is a continuation of application No. 12/425,590, filed on Apr. 17, 2009, now abandoned, which is a continuation of application No. 11/171,171, filed on Jun. 30, 2005, now Pat. No. 7,537,137, which is a continuation-in-part of application No. 10/683,311, filed on Oct. 10, 2003, now Pat. No. 7,213,720.

(60) Provisional application No. 60/417,533, filed on Oct. 10, 2002.

(51) Int. Cl.

| | |
|---|---|
| ***B65D 53/02*** | (2006.01) |
| ***B65B 5/04*** | (2006.01) |
| ***B65B 7/26*** | (2006.01) |
| ***A61J 1/03*** | (2006.01) |
| ***B65D 53/00*** | (2006.01) |
| ***B65D 43/16*** | (2006.01) |
| ***B65D 81/24*** | (2006.01) |
| ***B65B 51/22*** | (2006.01) |
| ***B65B 57/02*** | (2006.01) |
| ***B65B 61/20*** | (2006.01) |

(52) U.S. Cl.

CPC ..... *B65B 51/225* (2013.01); *B65B 57/02* (2013.01); *B65B 61/20* (2013.01); *B65D 43/16* (2013.01); *B65D 43/162* (2013.01); *B65D 43/163* (2013.01); *B65D 43/164* (2013.01); *B65D 53/00* (2013.01); *B65D 53/02* (2013.01); *B65D 81/24* (2013.01); *B65D 83/0805* (2013.01); *B65D 83/0823* (2013.01); *B65D 2251/105* (2013.01); *B65D 2251/1041* (2013.01); *B65D 2251/20* (2013.01); *B65D 2543/0099* (2013.01); *B65D 2543/00833* (2013.01)

(58) Field of Classification Search

USPC ..... 206/204

See application file for complete search history.

(56) References Cited

U.S. PATENT DOCUMENTS

| | | | | |
|---|---|---|---|---|
| 2,258,540 | A | 10/1941 | Cressaty | |
| 2,690,861 | A | 10/1954 | Tupper | |
| 2,814,404 | A | 11/1957 | Towns | |
| 3,227,332 | A | 1/1966 | Gowdy et al. | |
| 3,255,907 | A | 6/1966 | Eddy | |
| 3,272,368 | A | 9/1966 | Van Baarn | |
| 3,441,161 | A | 4/1969 | Van Baarn | |
| 3,784,055 | A | 1/1974 | Anderson | |
| 3,848,780 | A | 11/1974 | Stull | |
| 3,899,097 | A | 8/1975 | Aichinger | |
| 3,967,756 | A | 7/1976 | Barish | |
| 3,968,880 | A | 7/1976 | Ostrowsky | |
| 3,986,479 | A | 10/1976 | Bonk | |
| 3,994,417 | A | 11/1976 | Boedecker | |
| 4,036,360 | A | 7/1977 | Deffeyes | |
| 4,043,475 | A | 8/1977 | Wheeler | |
| 4,281,778 | A | 8/1981 | Stull | |
| 4,380,304 | A | 4/1983 | Anderson | |
| 4,730,731 | A | 3/1988 | Allison | |
| 4,746,008 | A | 5/1988 | Heverly et al. | |
| 4,759,463 | A | 7/1988 | Mazoin | |
| 4,778,071 | A | 10/1988 | Fillmore | |
| 4,783,056 | A | 11/1988 | Abrams | |
| 4,807,425 | A | 2/1989 | Abrams | |
| 4,812,116 | A | 3/1989 | Abrams | |
| 4,869,387 | A | 6/1989 | Perrson | |
| 4,883,056 | A | 11/1989 | Langham | |
| 4,890,742 | A | 1/1990 | Allison | |
| 4,964,539 | A | 10/1990 | Mueller | |
| 5,033,635 | A | 7/1991 | Batchelor | |
| 5,108,029 | A | 4/1992 | Abrams et al. | |
| 5,114,003 | A | 5/1992 | Jackish et al. | |
| 5,133,470 | A | 7/1992 | Abrams et al. | |
| 5,145,646 | A | 9/1992 | Tyranski | |
| 5,379,897 | A | 1/1995 | Muchenfuchs et al. | |
| 5,437,386 | A | 8/1995 | Von Holdt | |
| 5,474,177 | A | 12/1995 | Abrams et al. | |
| 5,542,567 | A | 8/1996 | Julius | |
| 5,553,739 | A | 9/1996 | Plum et al. | |
| 5,667,094 | A | 9/1997 | Rapcahk et al. | |
| 5,699,912 | A | 12/1997 | Ishikawa | |
| 5,723,085 | A | 3/1998 | Abrams | |
| 5,788,064 | A | 8/1998 | Sacherer | |
| 5,842,486 | A | 12/1998 | Davis et al. | |
| 5,911,937 | A | 6/1999 | Hekal | |
| 6,050,400 | A * | 4/2000 | Taskis | B65D 77/04 206/204 |
| 6,080,350 | A | 6/2000 | Hekal | |
| 6,092,690 | A | 7/2000 | Bitowft | |
| 6,124,006 | A | 9/2000 | Hekal | |
| 6,130,263 | A | 10/2000 | Hekal | |
| 6,174,952 | B1 | 1/2001 | Hekal et al. | |
| 6,214,255 | B1 | 4/2001 | Hekal | |
| 6,221,446 | B1 | 4/2001 | Hekal | |
| D443,450 | S | 6/2001 | Ruhotas | |
| 6,299,033 | B1 * | 10/2001 | VerWeyst | B65D 43/021 222/480 |
| 6,303,064 | B1 | 10/2001 | Abrams et al. | |
| RE37,676 | E | 4/2002 | Abrams | |
| 6,364,101 | B1 * | 4/2002 | Schultz | A47K 10/3818 206/210 |
| 6,394,298 | B1 | 5/2002 | Zaidman | |
| 6,412,634 | B1 * | 7/2002 | Telesca | A47K 10/421 206/494 |
| 6,486,261 | B1 | 11/2002 | Wu et al. | |
| 6,613,405 | B1 | 9/2003 | Hekal | |
| 6,769,558 | B1 | 8/2004 | Bucholtz | |
| 6,872,358 | B2 | 3/2005 | Hagen et al. | |
| 6,951,292 | B2 | 10/2005 | Bando et al. | |
| 6,964,349 | B2 | 11/2005 | Sears et al. | |
| 7,005,459 | B2 | 2/2006 | Hekal | |
| 7,213,720 | B2 | 5/2007 | Giraud | |
| 7,537,137 | B2 | 5/2009 | Giraud | |
| 7,753,228 | B2 | 7/2010 | Yuhara | |
| 2002/0185404 | A1 | 12/2002 | Donegan | |
| 2003/0173325 | A1 | 9/2003 | Mavin | |
| 2004/0173612 | A1 | 9/2004 | Giraud | |
| 2005/0258174 | A1 | 11/2005 | Giraud | |
| 2006/0196524 | A1 | 9/2006 | Kuhara | |
| 2007/0023317 | A1 | 1/2007 | Brozell | |
| 2007/0090106 | A1 | 4/2007 | Yuhara et al. | |
| 2009/0200326 | A1 | 8/2009 | Giraud et al. | |
| 2009/0236357 | A1 | 9/2009 | Giraud et al. | |

FOREIGN PATENT DOCUMENTS

| | | | |
|---|---|---|---|
| DE | 29705720 | U1 | 6/1997 |
| EP | 0079816 | A1 | 5/1983 |
| EP | 0208413 | A2 | 1/1987 |
| EP | 0328809 | A1 | 8/1989 |
| EP | 0454967 | B1 | 11/1991 |
| EP | 0857665 | A1 | 8/1998 |
| EP | 0916595 | A2 | 5/1999 |
| EP | 1582476 | A1 | 10/2005 |
| EP | 1595813 | A1 | 11/2005 |
| GB | 2205348 | A | 12/1988 |
| JP | 07-017748 | U | 3/1995 |

(56) References Cited

FOREIGN PATENT DOCUMENTS

| | | | | |
|---|---|---|---|---|
| JP | 08230920 | A | 9/1996 | |
| JP | 08337260 | A | 12/1996 | |
| JP | 0912064 | A | 1/1997 | |
| JP | 2002154594 | A | 5/2002 | |
| JP | 2004-299753 | A | 10/2004 | |
| JP | 2006-502062 | A | 1/2006 | |
| KR | 10-2011-0002347 | A | 1/2011 | |
| WO | 91/12181 | A1 | 8/1991 | |
| WO | 94/08872 | A1 | 4/1994 | |
| WO | 96/33108 | A1 | 10/1996 | |
| WO | WO 96/33108 | * | 10/1996 | ..... B65D 81/26 |
| WO | 2000/046118 | A1 | 8/2000 | |
| WO | 2001/053058 | A1 | 7/2001 | |
| WO | 2001/094240 | A1 | 12/2001 | |
| WO | 2004/026728 | A1 | 4/2004 | |
| WO | 2004/033339 | A1 | 4/2004 | |
| WO | 2005/074571 | A2 | 8/2005 | |
| WO | 2006/045087 | A2 | 4/2006 | |
| WO | 2006/137176 | A1 | 12/2006 | |
| WO | 2008/122771 | A1 | 10/2008 | |
| WO | 2008/146171 | A2 | 12/2008 | |
| WO | 2008/153953 | A1 | 12/2008 | |
| WO | 2008/153954 | A1 | 12/2008 | |
| WO | 2009/125267 | A1 | 10/2009 | |

OTHER PUBLICATIONS

Brief No. 2, Paris District Court, Parties: *CSP Technologies, Inc.*, Claimant, v. *AIRSEC*, Defendant, To Their Honors the President and Judges of the Paris District Court (3rd Division, Section 1) filed and served Jan. 21, 2013; 307 pages.

Conclusions pour La societe Airse, Defenderess, contre La societe CSP Technologies, Demanderesse, Tribunal de grande instance de Paris, 3e chambre, 1e section, Role No. 11/06900, Signifiees via e-barreau le Jan. 11, 2013 (Pleading on Behalf of Airsec, Defendant, Against CSP Technologies, Claimant, and Capital Europe, Voluntarily joining party. Tribunal de Grande Instance of Paris, 3rd Chamber, 1st Section, Served via e-barreau on Jan. 11, 2013); 381 pages.

Conclusions pour La Societe Airsec, Defenderesse, contre La societe CSP Technologies, Demanderesse, Tribunal de grande instance de Paris, 3e chamber, 1e section, Role No. 11/06900, Signifiees via e-barreau le Dec. 14, 2011 (Pleading on Behalf of Airsec, Defendant, Against CSP Technologies, Claimant, Tribunal de Grande Instance of Paris, 3rd Chamber, 1st Section, Served via e-barreau on Dec. 14, 2011); 104 Pages.

Brief No. 1, Paris District Court, Parties, *CSP Technologies, Inc.*, V. *AIRSEC*, Defendant, To Their Honors the President and Judges of the Paris District Court (3rd Division, Section 1), (General List), Hearing to close the procedural stage of proceedings on Jan. 22, 2012 at 3:30 p.m., Filed and Served on Nov. 15, 2012.

Conclusions Aux Fins De Sursis A Statuer devant le Tribunal de grande instance de Paris, Pour La Societe CSP Technlogies, Inc., Demanderesse, Contre La Societe AIRSEC, Defenderesse, 3eme chambre, 1ere section, RG No. 11/06900, Audience due May 16, 2012 (Motion For A Stay Of Proceedings Before the Court of First Instance of Paris, For CSP Technologies, Inc., Plaintiff Against AIRSEC, Defendant, 3rd chamber, 1st section, RG No. 11/06900, Hearing of May 16, 2012 (15 pages).

Order No. 9: Initial Determination Granting Motion To Withdraw Complaint And Terminate Investigation, in the Matter of Certain Flip-Top Vials and Products Using the Same, United States International Trade Commission, Investigation No. 337-TA-779, Aug. 29, 2011, (5 pages).

Order No. 8: Granting Unopposed Motion to Stay All Pending Deadlines, in the Matter of Certain Flip-Top Vials and Products Using the Same, United States International Trade Commission, Investigation No. 337-TA-779, Aug. 19, 2011, (3 pages).

Order No. 5: Setting Target Date of Sep. 24, 2012, in the Matter of Certain Flip-Top Vials and Products Using the Same, United States International Trade Commission, Investigation No. 337-TA-779, Jul. 21, 2011, (2 pages).

Order No. 4: Requesting Position Of Parties On Target Date by Jul. 20, 2011 And Suspending Preliminary Conference, in the Matter of Certain Flip-Top Vials and Products Using the Same, United States International Trade Commission, Investigation No. 337-TA-779, Jul. 18, 2011, (2 pages).

Order No. 1: Notice Of Ground Rules, Setting Jul. 18, 2011 Date For Discovery Statements, And Jul. 28, 2011 Date For Preliminary Conference, in the Matter of Certain Flip-Top Vials and Products Using the Same, United States International Trade Commission, Investigation No. 337-TA-779, Jun. 17, 2011, (6 pages).

Response And Affirmative Defenses of Sud-Chemie AG, Sud-Chemie, Inc., and Airsec S.A.S. To Complaint And Notice of Investigation, in the Matter of Certain Flip-Top Vials and Products Using the Same, United States International Trade Commission, Investigation No. 337-TA-779, Jul. 11, 2011, (51 pages).

Sud-Chemie AG's, Sud-Chemie Inc.'s, And Airsec S.A.S's First Set of Interrogatories Nos. 1-44 To Complaintant CSP Technologies, Inc., in the Matter of Certain Flip-Top Vials and Products Using the Same, United States International Trade Commission, Investigation No. 337-TA-779, Jun. 30, 2011, (26 pages).

Sud-Chemie AG's, Sud-Chemie Inc.'s, And Airsec S.A.S's First Set of Requests For Production Of Documents And Things Nos. 1-106 To Complaintant CSP Technologies, Inc., in the Matter of Certain Flip-Top Vials and Products Using the Same, United States International Trade Commission, Investigation No. 337-TA-779, Jun. 30, 2011, (28 pages).

Complainant CSP Technologies, Inc.'s First Set of Interrogatories To Respondents Sud-Chemie AG, Sud-Chemie, Inc. And Airsec S.A.S., in the Matter of Certain Flip-Top Vials and Products Using the Same, United States International Trade Commission, Investigation No. 337-TA-779, Jun. 30, 2011, (28 pages).

Complainant CSP Technologies, Inc.'s First Set of Requests For Production of Documents And Things To Respondents Sud-Chemie AG, Sud-Chemie, Inc.And Airsec S.A.S., in the Matter of Certain Flip-Top Vials and Products Using the Same, United States International Trade Commission, Investigation No. 337-TA-779, Jun. 30, 2011, (32 pages).

Complaint of CSP Technologies, Inc. Under Section 337 Of The Tariff Act of 1930, As Amended, in the Matter of Certain Flip-Top Vials and Products Using the Same, Public Version, United States International Trade Commission, May 16, 2011, (33 pages).

Plaintiff CSP Technologies, Inc.'s Reply In Support Of Its Motion For Partial Summary Judgement Of Direct Infringement, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Jan. 3, 2013, (23 pages).

Plaintiff CSP Technologies, Inc.'s Responsive Markman Brief, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Dec. 13, 2012, (23 pages).

Plaintiff CSP Technologies, Inc.'s Opening Markman Brief, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Nov. 11, 2012, (29 pages).

Responsive Expert Report Of Dr. Tim A. Osswald, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Oct. 12, 2012, (91 bages).

Rebuttal Expert Report And Declaration Of Neil Sheehan, Redacted Version, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Oct. 12, 2012, (73 pages).

(56) References Cited

OTHER PUBLICATIONS

Expert Report And Declaration Of Neil Sheehan, Redacted Version, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Aug. 13, 2012, (310 pages).

Sud-Chemie AG's, Sud-Chemie Inc.'s, And Airsec S.A.S's First Set Of Requests For Production Of Documents And Things Nos. 1-82 To Plaintiff CSP Technologies, Inc., in the Matter of *CSP Technologies, Inc.*, Plaintiff, v. *Sud-Chemie AG, Sud-Chemie, Inc.* and *Airsec S.A S*, Defendants, In the United States District Court For The Southern District Of Indiana New Albany Division, Civil Action No. 4:11-cv-00029-RLY-WGH, Jul. 3, 2012, (30 pages).

Sud-Chemie AG's, Sud-Chemie Inc.'s, And Airsec S.A.S's First Set Of Interrogatories Nos. 1-14 To Plaintiff CSP Technologies, Inc., in the Matter of *CSP Technologies, Inc.*, Plaintiff, v. *Sud-Chemie AG, Sud-Chemie, Inc.* and *Airsec S.A.S*, Defendants, In the United States District Court For The Southern District Of Indiana New Albany Division, Civil Action No. 4:11-cv-00029-RLY-WGH, Jul. 3, 2012, (14 pages).

Plaintiff CSP Technologies, Inc.'s Reply In Support Of Its Partial Motion For Judgement On The Pleadings For Failure To State A Claim Pursuant To FED. R. CIV. P. 12(b)(6) And FED. R. CIV. P. 12(c) And Motion To Strike, in the Matter of *CSP Technologies, Inc.*, Plaintiff, v. *Sud-Chemie AG, Sud-Chemie, Inc.* and *Airsec S.A.S*, Defendants, In the United States District Court For The Southern District Of Indiana New Albany Division, Civil Action No. 4:11-cv-00029-RLY-WGH, May 10, 2012, (14 pages).

Order On Defendant's Motion For Leave To File A Second Amended And United Answer, Affirmative Defenses, And Counterclaims, in the Matter of *CSP Technologies, Inc.*, Plaintiff, v. *Sud-Chemie AG, Sud-Chemie, Inc.* and *Airsec S.A.S*, Defendants, In the United States District Court For The Southern District Of Indiana New Albany Division, Civil Action No. 4:11-cv-00029-RLY-WGH, May 2, 2012, (7 pages).

Plaintiff CSP Technologies, Inc.'s Opposition to Defendeant SUD-CHEMIE AG, SUD-CHEMIE, Inc. and AIRSEC S.A.S.'s Motion For Leave To File A Second Amended And Unified Answer, Affirmative Defenses, And CounterClaims, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Mar. 19, 2012, (25 pages).

Smith, John D., Sud-Chemie AG's, Sud-Chemie Inc.'s, and Airsec S.A.S.'s Preliminary Invalidity Contentions, Mar. 30, 2012, pp. 1-31, Exhibits 20-21, 23-24, 27, 30-31, 33, C, D, F-L, Civ. Action 4:11-cv-00029-RLY-WGH, New Albany, IN.

Order On Case Management Plan, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Nov. 29, 2011, (3 pages).

Defendants' Unopposed Motion To Stay, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Jun. 23, 2011, (51 pages).

Reply In Support Of Notice Of Related Case; in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Jun. 17, 2011, (22 pages).

Declaration Of George P. McAndrews In Support Of Plaintiff CSP Technologies, Inc.'s Opposition To Defendant Sud-Chemin AG's Motion To Dismiss For Lack Of Personal Jurisdiction, in the Matter of *CSP Technologies, Inc.*, Plaintiff, v. *Sud-Chemie AG, Sud-Chemie, Inc.* and *AIRSEC S.A.S*, Defendants, In the United States District Court For The Southern District Of Indiana New Albany Division, Civil Action No. 4:11-cv-00029-RLY-WGH, Jun. 15, 2011, (27 pages).

Plaintiff CSP Technologies, Inc.'s Opposition To Defendant Sud-Chemie AG's Motion To Dismiss For Lack Of Personal Jurisdiction, in the Matter of *CSP Technologies, Inc.*, Plaintiff, v. *Sud-Chemie AG, Sud-Chemie, Inc.* and *Airsec S.A.S*, Defendants, In the United States District Court For The Southern District Of Indiana New Albany Division, Civil Action No. 4:11-cv-00029-RLY-WGH, Jun. 15, 2011, (27 pages).

Declaration Of Robert S. Abrams In Support Of Plaintiff CSP Technologies, Inc.'s Opposition To Defendant Sud-Chemie AG's Motion To Dismiss For Lack Of Personal Jurisdiction, in the Matter of *CSP Technologies, Inc.*, Plaintiff, v. *Sud-Chemie AG, Sud-Chemie, Inc.* and *Airsec S.A.S*, Defendants, In the United States District Court For The Southern District Of Indiana New Albany Division, Civil Action No. 4:11-cv-00029-RLY-WGH, Jun. 15, 2011, (8 pages).

Answer To Defendants And Counterclaim Plaintiffs Sud-Chemie, Inc.'s And AIRSEC S.A.S.'s Counterclaims, in the Matter of*CSP Technologies, Inc.*, Plaintiff, v. *Sud-Chemie AG, Sud-Chemie, Inc.* and *AIRSEC S.A.S*, Defendants, In the United States District Court For The Southern District Of Indiana New Albany Division, Civil Action No. 4:11-cv-00029-RLY-WGH, Jun. 15, 2011, (14 pages).

Response To CSP Technologies, Inc.'s Notice Of Related Case, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, May 26, 2011, (8 pages).

Sud-Chemie AG's Memorandum In Support Of Its Motion To Dismiss For Lack Of Personal Jurisdiction, in the Matter of *CSP Technologies, Inc.*, Plaintiff, v. *Sud-Chemie AG, Sud-Chemie, Inc.* and *AIRSEC S.A.S*, Defendants, In the United States District Court For The Southern District Of Indiana New Albany Division, Civil Action No. 4:11-v-00029-RLY-WGH, May 19, 2011, (11 pages).

Sud-Chemie AG's Motion To Dismiss For Lack Of Personal Jurisdiction, in the Matter of *CSP Technologies, Inc.*, Plaintiff, v. *Sud-Chemie AG, Sud-Chemie, Inc.* and *AIRSEC S.A.S*, Defendants, In the United States District Court For The Southern District Of Indiana New Albany Division, Civil Action No. 4:11-cv-00029-RLY-WGH, May 19, 2011, (4 pages).

Sud-Chemie Inc.'s And AIRSEC S.A.S.'s Answer, Affirmative Defenses And Counterclaims, in the Matter of *CSP Technologies, Inc.*, Plaintiff, v. *Sud-Chemie AG, Sud-Chemie, Inc.* and *AIRSEC S.A.S*, Defendants, In the United States District Court For The Southern District Of Indiana New Albany Division, Civil Action No. 4:11-cv-00029-RLY-WGH, May 19, 2011, (29 pages).

Declaration Of Edgar Binnemann In Support Of Defendant Sud-Chemie AG's Motion To Dismiss Pursuant To Rule 12 (b)(2), in the Matter of *CSP Technologies, Inc.*, Plaintiff, v. *Sud-Chemie AG, Sud-Chemie, Inc.* and *AIRSEC S.A.S*, Defendants, In the United States District Court For The Southern District Of Indiana New Albany Division, Civil Action No. 4:11-cv-00029-RLY-WGH, May 19, 2011, (5 pages).

Summons In A Civil Action To Sud-Chemie, Inc., in the Matter of *CSP Technologies, Inc.*, Plaintiff, v. *Sud-Chemie AG, Sud-Chemie, Inc.* and *AIRSEC S.A.S*, Defendants, In the United States District Court For The Southern District Of Indiana New Albany Division, Civil Action No. 4:11-cv-00029-RLY-WGH, Mar. 14, 2011, (3 pages).

Summons In A Civil Action To Airsec S.A.S., in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Mar. 14, 2011, (3 pages).

Summons In A Civil Action To Sud-Chemie AG, in the Matter of *CSP Technologies, Inc.*, Plaintiff, v. *Sud-Chemie AG, Sud-Chemie, Inc.* and *AIRSEC S.A.S*, Defendants, In the United States District

(56) References Cited

OTHER PUBLICATIONS

Court For The Southern District Of Indiana New Albany Division, Civil Action No. 4:11-cv-00029-RLY-WGH, Mar. 14, 2011, (3 pages).
Plaintiff CSP Technologies, Inc.'s Rule 7.1 Disclosure Statement, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Mar. 11, 2011, (2 pages).
Civil Cover Sheet, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Mar. 11, 2011, (3 pages).
Complaint For Patent Infringement, in the Matter of *CSP Technologies, Inc.*, Plaintiff, v. *SUD-CHEMIE AG, SUD-CHEMIE, Inc.* and *AIRSEC S.A.S*, Defendants, In the United States District Court For The Southern District Of Indiana New Albany Division, Civil Action No. 4:11-cv-00029-RLY-WGH, Mar. 11, 2011, (34 pages).
Rucknahme der Klage, In Sachen CSP Technologies, Inc. gegen Sud-Chemie AG, 7 O 5212/11, Landgericht Munchen , I 7.Zivilkammer, Lenbachplatz 7, 80316 Munchen, Munchen, Jul. 7, 2011 (Withdrawal Of Complaint, In the matter of CSP Technologies, Inc. against Sud-Chemie AG,-7 O 5212/11-, Munich District Court I, Patent Dispute Division, Lenbachplatz 7, 80316 Munich, Munchen, Jul. 7, 2011); 2 pages.
Die Frist zur Stellungnahme auf den PKS-Antrag um 3 Wochen, d.h. bis zum Jul. 1, 2011 zu verlangern, Landgericht Munchen I, 7.Zivilkammer, Lenbachplatz 7, 80316 Munchen, Munchen, Jun. 10, 2011 (We first rais the objection that no security for the legal costs has been furnished, In the matter of *CSP Technologies, Inc.* versus *Sud-Chemie AG*,-7 O 5212/11-, Regional Court Munich I, 7th Civil Division, 80316 Munich, Munchen, Jul. 7, 2011); 69 pages.
Klage, der CSP Technologies, Inc.,-Klagerin-gegen die Sud-Chemie AG,-Beklagte-, Landgericht Munchen I, 7. Zivilkammer, Lenbachplatz 7, 80316 Munchen, Munchen, Mar. 14, 2011 (Action of CSP Technologies, Inc.,-Plaintiff-, against Sud-Chemie AG,-Defendant-, Munich District Court I, Patent Dispute Division, Lenbachplatz 7, 80316 Munich, Munucg, Mar. 14, 2011); 70 pages.
International Search Report and the Written Opinion of the International Searching Authority, or the Declaration, in International application No. PCT/US2012/025813, dated Dec. 6, 2012. (8 pages).
PCT Notification of Transmittal of International Search Report and Written Opinion of the International Searching Authority, in International application No. PCT/EP2010/062357, dated Aug. 24, 2010.
European Search Report for European Patent No. 10155973.0 dated Jul. 8, 2010.
The Patent Office of the People's Republic Of China, Notification Of First Office Action, in application No. CN200780038497.4, dated Mar. 23, 2010.
Canadian Intellectual Property Office, Office Action in Canadian Application No. 2662751, dated Mar. 24, 2011.
International Preliminary Report on Patentability corresponding to International Application No. PCT/US2007/077702, dated Mar. 19, 2009.
European Patent Office, Communication with extended European Search Report in International Application No. 11075189.8-1261/2386496, dated Dec. 22, 2011.
Japanese Patent Office, Notice of Reason(s) for Rejection, in Japanese Patent Application No. 2009-527556, dated Aug. 7, 2012, with translation.
United States Patent and Trademark Office, Before the Patent Trial and Appeal Board, Final Written Decision, Case IPR2014-00375, U.S. Pat. No. 8,528,778 B2, dated Jun. 10, 2015.

* cited by examiner

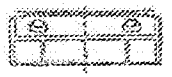
FIG. 12A
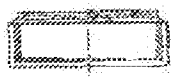
FIG. 12B
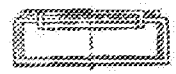
FIG. 12C
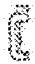
FIG. 12D
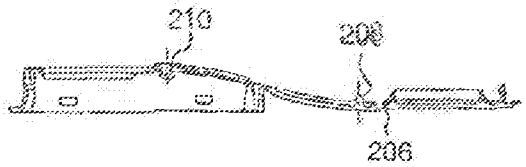
FIG. 12M
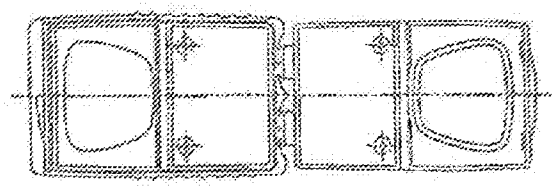
FIG. 12N
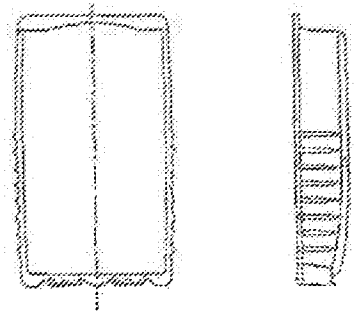
FIG. 12E
FIG. 12F
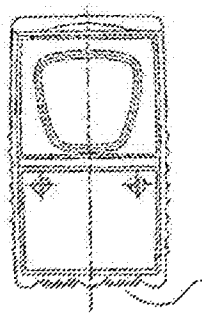
FIG. 12G
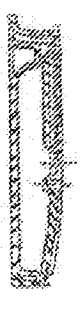
FIG. 12H
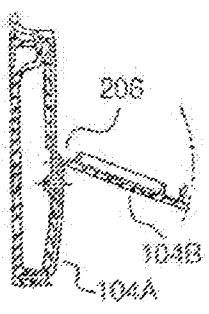
FIG. 12I
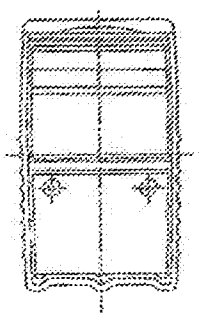
FIG. 12J
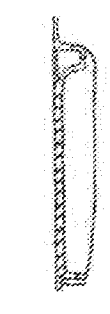
FIG. 12K
FIG. 12L

RESEALABLE MOISTURE TIGHT CONTAINER ASSEMBLY FOR STRIPS AND THE LIKE HAVING A LIP SNAP SEAL

CROSS-REFERENCE TO RELATED APPLICATIONS

This application is a continuation of U.S. application Ser. No. 14/202,867, filed Mar. 10, 2014, which is a continuation of Ser. No. 13/944,708, filed Jul. 17, 2013, which is a continuation of Ser. No. 13/533,233, filed Jun. 26, 2012, which is a continuation of U.S. application Ser. No. 12/425,590, filed Apr. 17, 2009, which is a continuation of U.S. application Ser. No. 11/171,171, filed Jun. 30, 2005, which is a continuation-in-part of U.S. application Ser. No. 10/683,311, filed Oct. 10, 2003, which claims a benefit under 35 U.S.C. 119(e) of U.S. Provisional Application Ser. No. 60/417,533, filed Oct. 10, 2002, all of which are hereby incorporated by reference herein in their entirety for all purposes.

FIELD OF THE INVENTION

The present invention relates to a resealable container and lid assembly having a lip snap seal for storing and packaging moisture-sensitive items, including but not limited to edible breath-freshening strips, drug-delivery strips, diagnostic test strips, and effervescent tablets.

SUMMARY OF THE INVENTION

The present invention relates to a resealable container and lid assembly having a lip snap seal for storing and packaging moisture-sensitive items, including but not limited to edible breath-freshening strips, drug delivery strips, diagnostic test strips, and effervescent tablets.

The container assembly substantially prohibits the ingress of moisture into the container assembly through the lid when the container is sealed. In other words, it is substantially moisture-proof. In another aspect of the invention, the container assembly is provided with a desiccant or similar material, which reduces the moisture present within the container when it is sealed. That is, after the container has been sealed, the desiccant absorbs moisture present therein. Likewise, after the container has been opened and then resealed, the desiccant absorbs moisture that entered the cavity when the container was opened.

In one embodiment of the present invention, the assembly comprises a lid and container that may be attached by a hinge. The hinge has a recess. The recess forms two elements, the first element being attached to the lid portion and the second element being attached to the container portion. In still a further embodiment, the recess functions as a bending point during the opening and closing of the container assembly.

The container has a sidewall depending downwardly from a top container surface. A bottom container surface is joined to the sidewall. The top container surface is provided with an opening, permitting access to the interior of the container. The opening is bounded by a lip that depends upward from the top container surface. A rim is positioned on the outside of the upper end of the lip.

In one example, the lid portion of the assembly is attached to the container portion by a hinge. The lid portion has a base portion with an outer periphery that extends over the container portion. In one embodiment, a portion of the base portion serves as a tab for facilitating the opening and closing of the container assembly. In yet another embodiment, the base portion is provided with a skirt that depends downwardly from a central portion of the base portion. The skirt is positioned at a location on the base portion that allows the skirt to enter into a closing relationship with lip of the container portion, in which the skirt of the base portion fits over the periphery of the lip provided on the top container surface (or, as the case may be, the skirt fits within the periphery of the lip). The skirt of the base portion has an end distal to where the skirt joins the lid portion. At the distal end of the skirt, the skirt is provided with an inward extension, which extends around the interior periphery of the skirt. Similarly, the lip of the container portion is provided with an end distal to where the lip joins the container portion, and the distal end of the lip is provided with an outward facing extension, which extends around the periphery of the lip. In effect, the extension on the skirt and the extension on the lip face each other. In constructing this arrangement on the skirt and lip, the extensions will abut and interlock with each other when the lid is closed on the container portion. In this arrangement, the interlocking, abutting extensions will form at least a substantially moisture-tight sealing arrangement with each other.

In yet another embodiment, a lip seal member depends downwardly and extends around the lid portion. The lip seal member is positioned interior to the skirt, which also depends downwardly from the base portion. Further, the lip seal member is positioned to lie interior of the lip extending upward from the container portion. When the lid is in the closed position, the lip seal member abuts the interior side of the distal end of the lip. In this arrangement, the lip seal (1) provides a sealing position, in addition to the one between the skirt and the lip; and (2) applies pressure on the lip from the inside out, which in turn applies pressure on the skirt, thereby applying tightening the seal between the skirt and the lip.

In yet another embodiment, the lid and/or container contain a desiccant, in the shape of a disc (e.g. puck), sleeve, or other desired shapes.

In yet another embodiment, the assembly includes an elastomeric liner applied to selected regions of the assembly. For example, elastomeric liner may be positioned on the interior surface of the lid, between the skirt and where the lip seals are provided, it may line the lip seals as well.

In yet another embodiment, the skirt depending downward from the base portion has a distal end that is provided with an inward extension. The lip has an end distal to the location where the lip joins the container top surface, where the recess is positioned. The recess is adapted to receive the extension when the lid portion is closed upon the container portion.

In a further embodiment, the container assembly of the present invention is formed of a plastic material, by injection molding or other suitable molding techniques. For example, the assembly may be molded of polypropylene. The assembly comprises a base and an upper housing that can be molded separately, the base can be loaded with the item to be retained in the container, and then the base and upper housing can be snap-fit together employing a lip seal in order to provide moisture-tightness.

In one embodiment, the containers of the present invention have a relatively small height dimension, making them well adapted to fit in a handbag, purse, or pocket. Despite this small height dimension, the container is well suited to storing items such as candies, edible breath-freshening strips, and diagnostic test strips, such as those employed in testing blood glucose levels.

In yet another embodiment, the opening of the container is irregular in its shape, not having a uniform radius. In other words, it is not circular.

BRIEF DESCRIPTION OF THE DRAWINGS

FIGS. 12A to 12N illustrate views of yet another embodiment of the present invention.

DETAILED DESCRIPTION OF THE EMBODIMENTS

Figure 1:
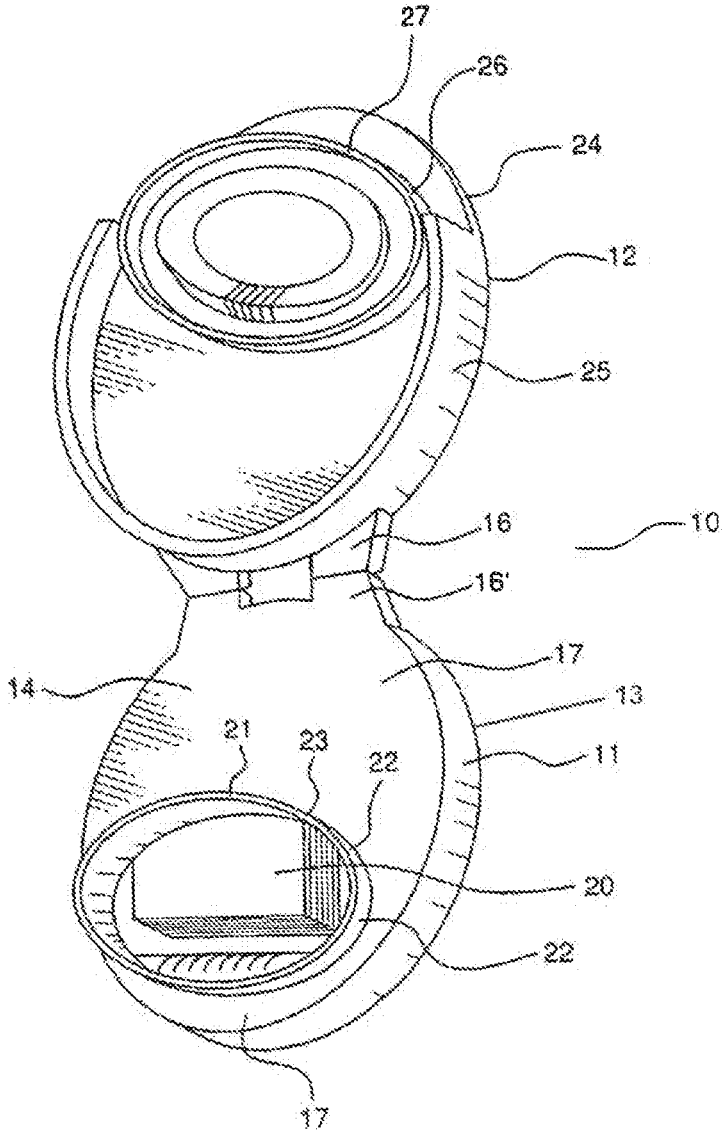
FIG. 1 is a perspective view of a container of the present invention.

The present invention relates to a container and lid assembly for storing and packaging moisture-sensitive items, including but not limited to edible breath-freshening strips, drug-delivery strips, diagnostic test strips, and effervescent tablets, that substantially prohibits the ingress of moisture into the assembly through the lid when the container and lid are sealed.

In one embodiment, the assembly 10 is generally provided with a lid portion 12 and container portion 14 that are attached by a hinge 16. The hinge 16 has a recess 16'. The recess 16' forms two elements, the first element being attached to the lid portion and the second element being attached to the container portion In still a further embodiment, the recess functions as a bending point during the opening and closing of the container assembly.

The container portion has a container base 13, and a sidewall 11 depending upwardly from the base 13. A top container surface 17 extends inward from the sidewall The top container surface 17 is provided with an opening 20, permitting access to the interior of the container. The opening 20 is bounded by a lip 22 that extends upward from the top container surface 17. Lip 22 extends around the periphery of the opening 20. The lip 22 has an end 21 distal to the location where the lip joins the container top surface, where an extension 23 is positioned and faces outward, relative to the opening 20. The extension 23 extends around the periphery of the lip distal end 21.

The lid portion 12 has a base portion 24 with an outer periphery 25 that extends over at least a portion of the container portion, in one embodiment, a portion of the base portion 24 serves as a tab 13 for facilitating the opening and closing of the container assembly. The base portion 24 is provided with a skirt 26 that depends downwardly the base portion. The skirt 26 is positioned at a location on the base portion 24 that allows the skirt 26 to enter into a closing relationship with lip 22 of the container portion 14, in which the skirt 26 of the base portion 24 fits over the periphery of the lip 22 provided on the top container surface (or, as the case may be, the skirt fits within the periphery of the lip). The skirt 26 of the base portion 24 has an end 27 distal to the end at which the skirt joins the lid portion. At the distal end 27 of the skirt, the skirt is provided with an inward extension 28, which extends around the interior periphery of the skirt. At the distal end 27 of the skirt, the skirt is provided with an inward facing extension 28, which extends around the periphery of the skirt distal end 27. When the lid portion is closed on the container portion, the extension 28 on the skirt 26 and the extension 23 on the lip 22 face each other. Further, when the lid portion is closed on the container portion, the extensions will abut and interlock with each other. In this arrangement, the interlocking, abutting extensions will form a moisture-tight seal with each other.

Figure 3:
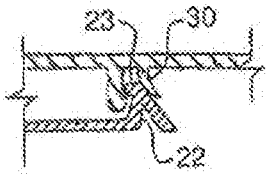
FIG. 3 is a side elevational view of a lip seal for a container of the present invention.
Figure 4:
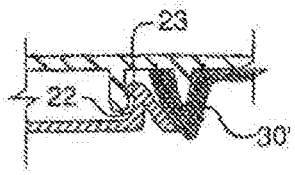
FIG. 4 is a side elevational view of another lip seal for a container of the present invention.

In yet another embodiment, a lip seal member 30 depends downwardly and extends around the inside of the lid portion 12. The lip seal member 30 is positioned interior to the skirt 26 which also depending downwardly from the base portion 24. Further, the lip seal member 30 is positioned to lie interior of the lip 22 that extends upward from the container portion 14, and about the interior side of the distal end of the lip 22, when the lid is in the closed position. In this arrangement, as shown in FIG. 3, the lip seal (1) provides a sealing position, in addition to the one between the skirt and the lip and (2) applies pressure on the lip from the inside out, which in turn applies pressure on the skirt, thereby applying tightening the seal between the skirt and the lip. FIG. 4 shows a component 30' present as a hollowed out member.

Figure 10:
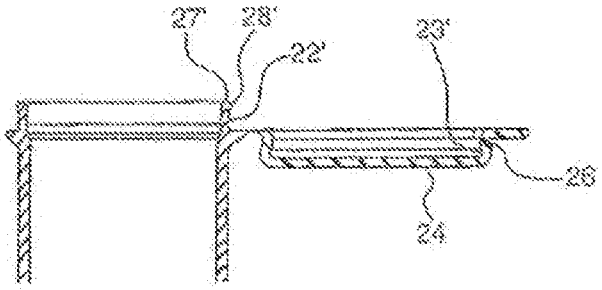
FIG. 10 is a cross sectional view of another embodiment of a container of the present invention.
Figure 11:
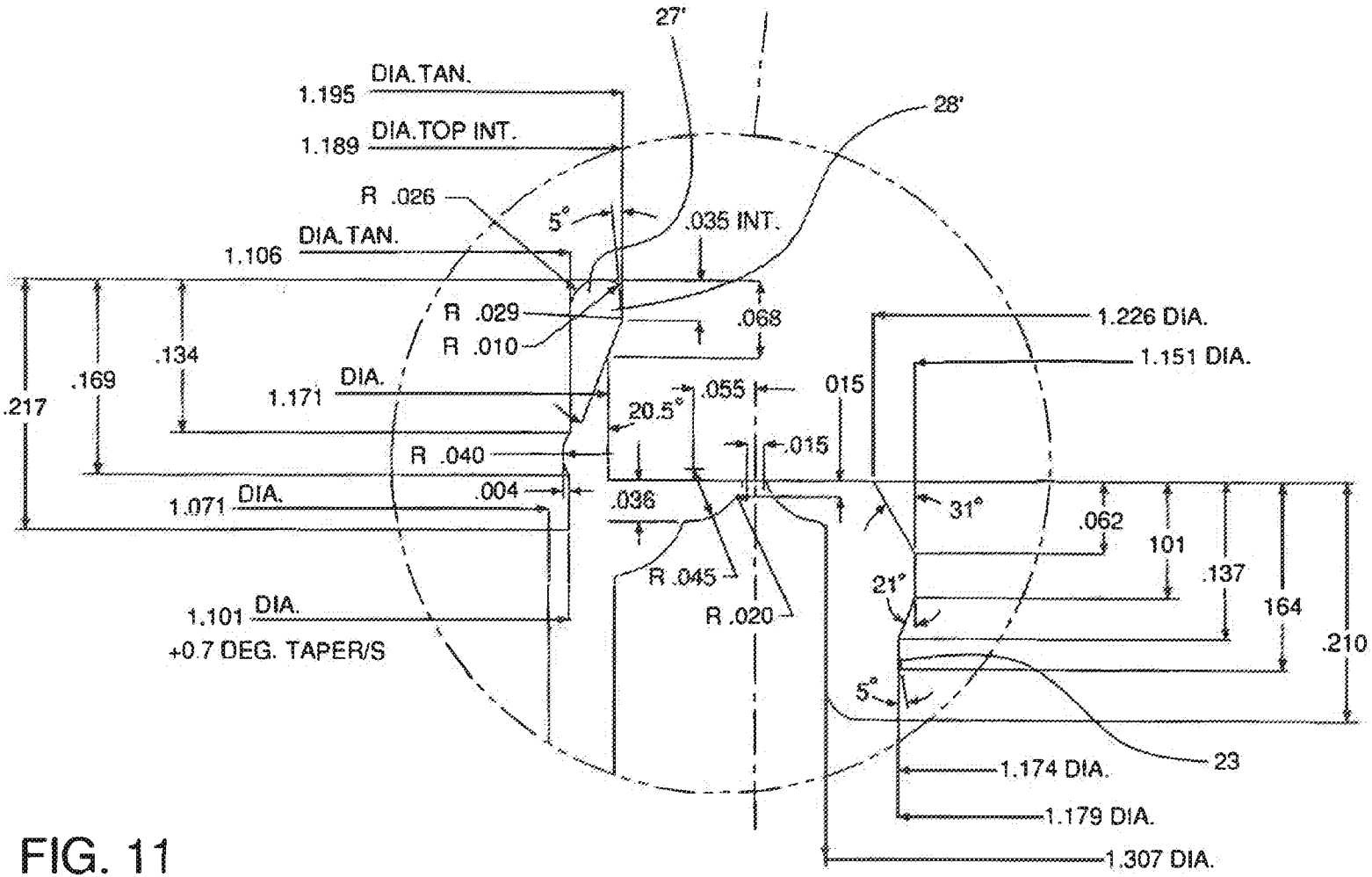
FIG. 11 is a perspective view showing features of the embodiment of FIG. 10.

In yet another embodiment, shown in FIGS. 10 and 11, the structure of the lip 22' has a distal end 27' provided with an extension 28'. The skirt 26' has a recess 23' positioned near where the skirt depends from the base portion 24'. The recess 23' is adapted to receive the extension 28' when the lid portion is closed upon the container portion. When the lid portion is closed on the container portion, the abutting arrangement between the lip and the skirt, and presence of the extension within the recess, forms a substantially moisture tight seal. FIG. 11 shows the configuration for such an arrangement.

Figure 2:
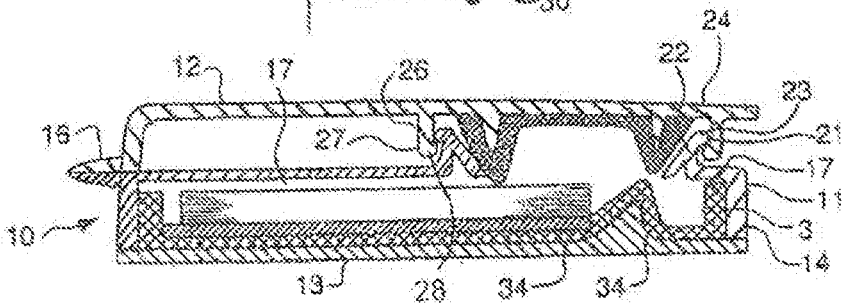
FIG. 2. is a cross sectional view of a container of the present invention.
Figure 5:
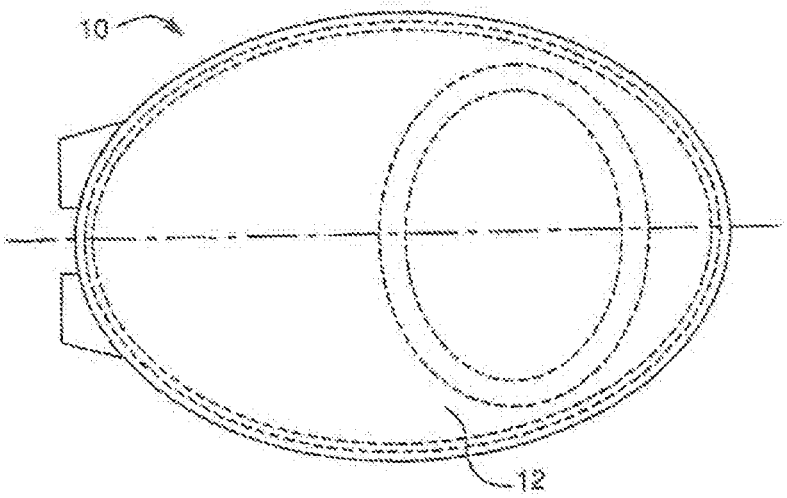
FIG. 5 is a top plan view of a container of the present invention.
Figure 6:
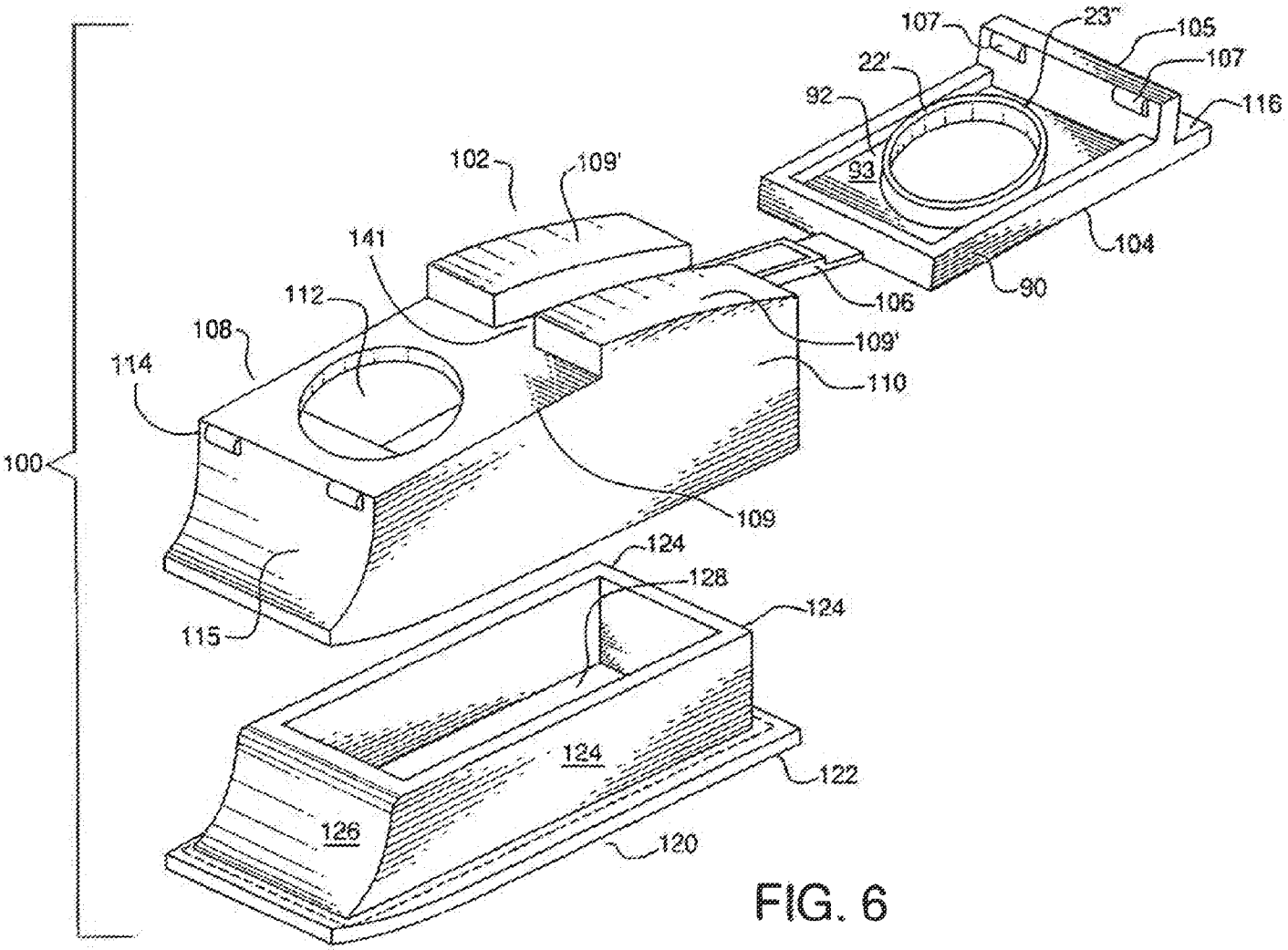
FIG. 6 is an exploded view of a container of the present invention.

In yet another embodiment, the lid and/or container contain a desiccant, in the shape of a disc (e.g. puck), sleeve, or other shapes. In one embodiment, a desiccant entrained plastic is located in a desiccant liner that covers at least a portion of the lid and/or container, such as the desiccant-entrained plastic sleeve 34 positioned at the bottom of the container. See FIG. 2, where the sleeve 34 is shown surrounding the item stored within the container on three of the item's sides. In one embodiment, such a sleeve or liner can surround the stored item(s) on more or less than three sides. See, e.g., FIG. 7, where the desiccant insert is positioned on the container base. When the container assembly is repeatedly opened and closed, the desiccant-entrained plastic sleeve re-establishes the low relative humidity environment inside the container assembly in a short period of time (e.g. in as low as less than about one minute), when a desiccant, such as the sleeve of FIG. 2, is included in the assembly.

The desiccant-entrained plastic contains a desiccant such as silica gel or molecular sieve as the desiccant. Depending on the application, such as the application intended by the end user, molecular sieve or silica gel desiccant can be provided in the sleeve. For example, molecular sieve can be used for applications that require a low RH (e.g. less than <10% RH) maintained over the shelf life. In another example, silica gel can maintain a RH of 10-30% over a two-year shelf life.

Suitable desiccant entrained plastic include, but are not limited to, these desiccant plastics disclosed in U.S. Pat. Nos. 5,911,937, 6,214,255, 6,130,263, 6,080,350 and 6,174,952, 6,124,006, and 6,221,446. These references are incorporated herein by Reference. By varying the desiccant loading and channeling agent in the plastic formulation, the overall moisture capacity and uptake rate of the desiccant entrained plastic can be controlled. In embodiments where containers include desiccant material, they may be formed by two shot molding techniques.

In yet another embodiment, the assembly includes an elastomeric liner 36 applied to selected regions of the assembly. For example, elastomeric liner may be positioned on the interior surface of the lid portion, lying inside the skirt. Where the lip seals are provided, it may line them as well. In one example, a suitable elastomer is EPDM, commercially available under the trade name Santoprene.

The containers of the present invention are formed of plastic materials, by injection molding or other suitable molding techniques. For example, the containers may be molded of polypropylene. In one embodiment, the containers can be formed as a single closed unit, with the hinge joining the lid portion to the container portion.

In yet another embodiment, the container assembly comprising the base and upper housing portion can be molded separately. As such, in one example, the base portion can be loaded with the item(s) to be retained in the container assembly, and then the upper housing portion can be snap-fit with the base by employing a lip seal mechanism in order to provide moisture-tightness. Consequently, the container and lid assembly can be fit together, and the parts joined without the need for additional sealing methods, e.g., by welding (such as by sonic welding or by thermal welding).

Figure 14:
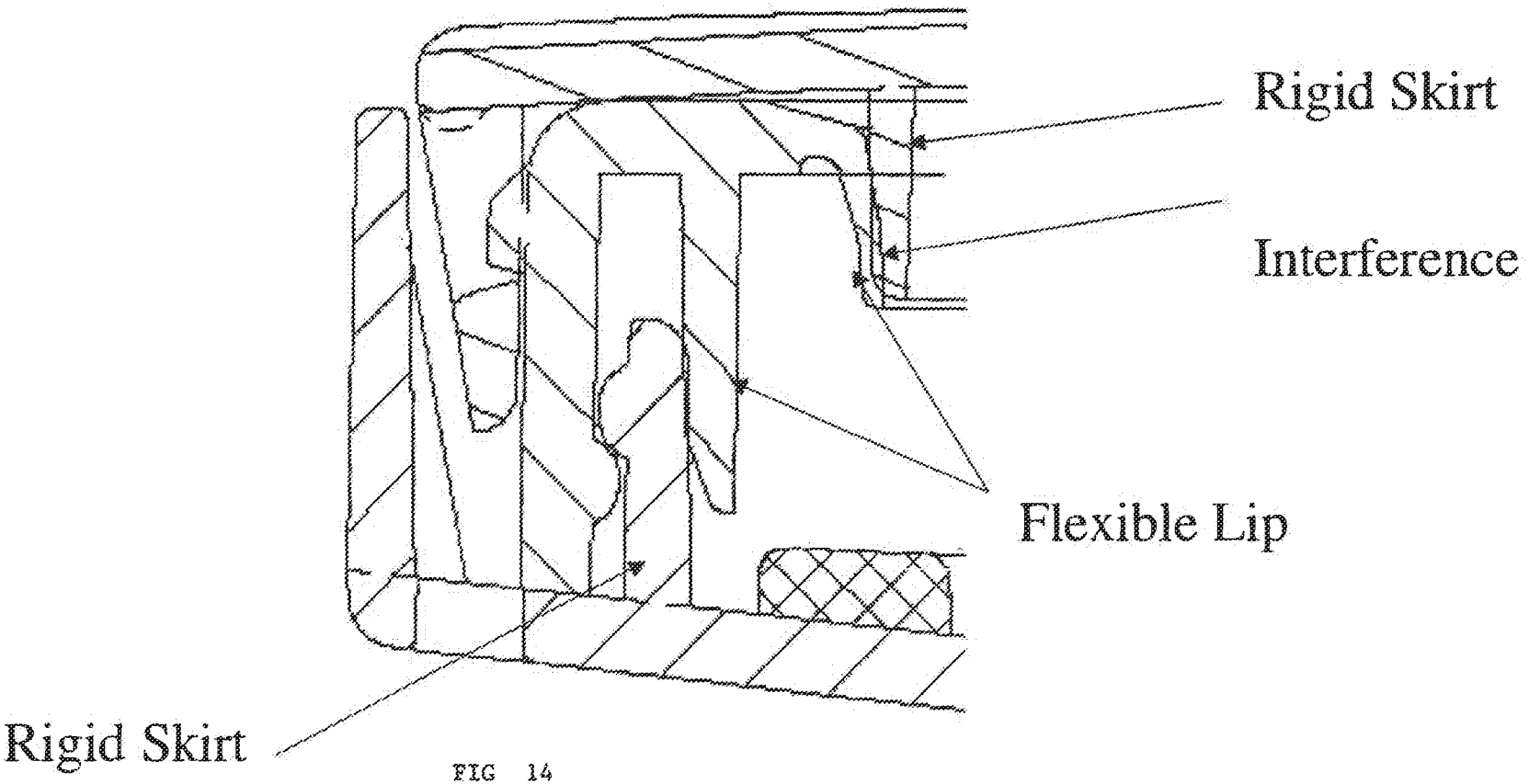
FIG. 14 is a cross-sectional view of an enlarged section of one end of the base and upper housing assembly illustrating the snap lip seal.

FIG. 14 illustrates one embodiment of the container assembly having a snap-fit by employing a lip seal mechanism. In FIG. 14, a lip seal member 300 of the upper housing portion depends downwardly and extends around the inside of the base portion. The lip seal member 300 is positioned interior to a skirt which also depending downwardly from the upper housing portion. Further, the lip seal member 300 is positioned to lie interior of a lip that extends upward from the base portion, and about the interior side of the distal end of the lip, when the base portion is snap sealed with the upper housing portion. In one example, the lip seal (1) provides a sealing position, in addition to the one between the skirt and the lip; and (2) applies pressure on the lip from the inside out, which in turn applies pressure on the skirt, thereby applying tightening the seal between the skirt and the lip.

In a further embodiment of the lip seal mechanism, lip seal mechanism is designed to be sufficiently deflective so as to assist in the formation of a seal. As examples, the design of degree of deflection of the flexible lip can include, but is not limited to, the composition of the flexible lip (e.g. type of plastic), the thickness of the flexible lip, the curvature of the flexible lip, the length of the flexible lip and/or any attachments to the flexible lip.

In a further embodiment, the lid and container can be formed in a single piece (for example, joined at the hinge), yet open, as in a clamshell arrangement. The assembly can be filled with contents, closed shut, and then joined, e.g., welded to form a seal, as described above.

Figure 7:
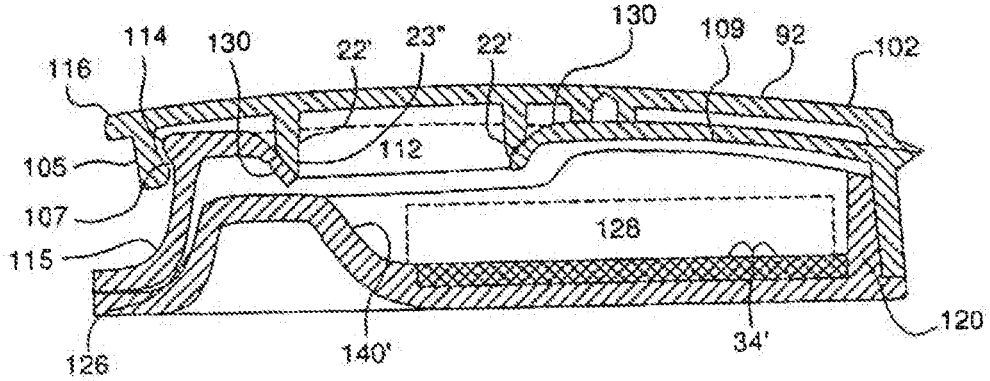
FIG. 7 is a cross sectional view of a container of the present invention.
Figure 7A:
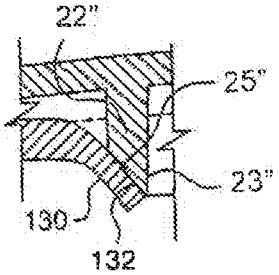
FIG. 7A is a perspective view of a feature shown in the FIG. 7 embodiment.

An embodiment depicting a two-part assembly is illustrated in FIGS. 6 to 9 and 12. In this embodiment, assembly 100 is provided with cover component 102 and tray component 120. The cover component 102 has a lid portion 104 that is joined to upper component 108 by hinge 106. As shown, lid portion 104 has sidewalls 90 located at the periphery of the lid base 92. The hinge 106 is joined to one of the sidewalls 90. Within the space of the sidewalls, the underside of the lid base 92 has a recess 93 in which the lip 22", depending from the lid base 92, is located. As shown in FIG. 7, the lip 22", which extends in a loop around a portion of the lid base 92, is positioned to be received in the opening 112 of upper component 108, when the lid portion is closed on the opening 112. The lip 22" is provided with an end 23" distal to where the lip 22" is joined to the lid base 92. As best seen in FIG. 7A, the distal end 23" of lip 22" has a tapered edge 25", which is adapted to lie substantially flush against the surface 132 of the edge 130, when the lip 22" of the lid portion 104 is closed on the opening 112 of the upper component 108. Thus, when the lid portion 104 is closed on the opening 112 of the upper component 108, the tapered edge 25" of the lip 22" lies substantially flush against the flexible edge 130 surrounding the opening 112 in the top surface 109 of the cover component 102.

At the end of the lid portion 104 that is opposite the hinge, lid latch component 105, depending from the lid base 92, is located. In one embodiment, hooks 107 are provided on the lid latch 105. In another embodiment, a tab 116, to facilitate opening of the lid portion, when it is closed on the opening 112, is provided on the lid portion.

Upper component 108 has top wall 109 from which sidewalk 110 and sloped wall 115 depend downward. Opening 112 is provided in the top wall 109. In the embodiment relating to hooks, hooks configured to mate with and compliment the hooks 107 on the lid portion 104 are positioned at one end of the upper component 108. At the end opposite where the hooks are positioned, hinge 106 is joined to the upper component 108. The upper component may have a recess 111 for the hinge 106, positioned between elevated portions 109' of top wall 109.

The tray component 120 is provided with sidewalk 124 and sloped wall 126 depending upward from the base of the tray 122. Sloped wall 126 is complimentary in its shape to the sloped wall 115 of the upper component 108. The side walls define a cavity 128 where items can be stored.

As best seen in FIG. 7, the edges 130 of the opening 112 provided in the top wall 109 are formed of a flexible plastic material that slopes downward, into the opening 112. The edges extend around the periphery of the opening 112.

Again, seen in FIG. 7A, the distal end 23" of lip 22" has a tapered edge 25", which is adapted to lie flush against the surface 132 of the edge 130, when the lip 22" of the lid portion 104 is closed on the opening 112 of the upper component 108. Thus, when the lid portion 104 is closed on the opening 112 of the upper component 108, the tapered edge 25" of the lip 22" lies flush against the flexible edge 130 surrounding the opening 112 in the top surface 109 of the upper component 108, thereby sealing the opening from substantial moisture ingress.

In the closed position (FIG. 7), hooks 107, 114, provided on the lid portion 104 and the upper component 108, respectively, are engaged with each other, to maintain the lid portion 104 closed on the upper component 108.

The cover component 102 is adapted to fit over the tray component 120, in order to form a container assembly. The cover component and the tray component can be loaded with items to be dispensed through the opening and then joined together, in the ways previously described herein.

Figure 8:
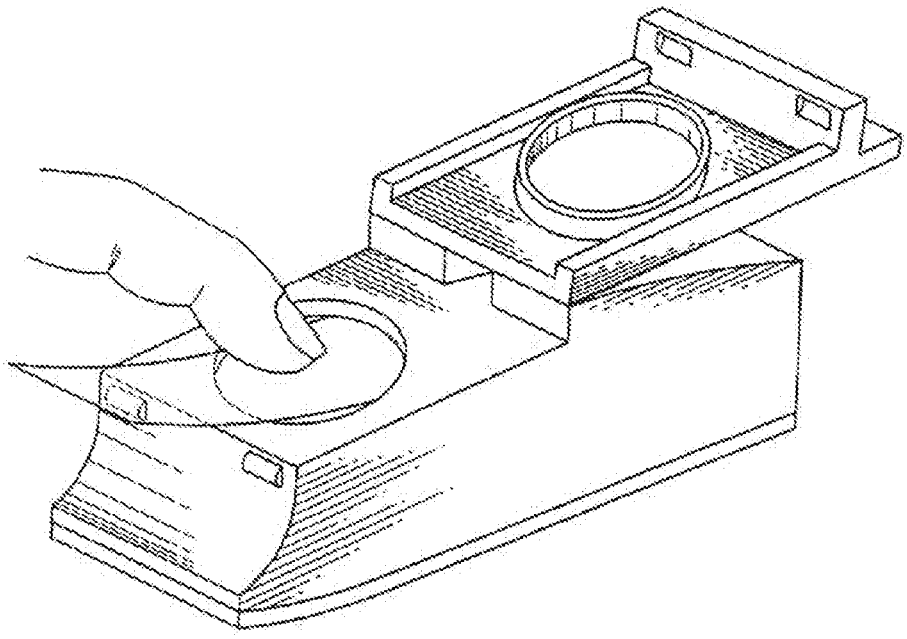
FIG. 8 is a perspective view of a container of the present invention, as an item is removed from the container.

As seen in FIG. 7, a stack of items is positioned in the container. Opening 112 is sized to permit a person to insert at least a portion of his or her finger therein. As shown in FIG. 8, a person can slide a portion of the index finger inside the hole, sliding an item up the sloped wall of the cavity 128 (FIG. 7), and through the opening.

A desiccant material, such as a desiccant sleeve, can be positioned in the container. As shown in FIG. 7, the sleeve 34' may be positioned along the base 122 of the tray component, or anywhere else along the interior of the assembly, where the item(s) is stored.

Figure 9:
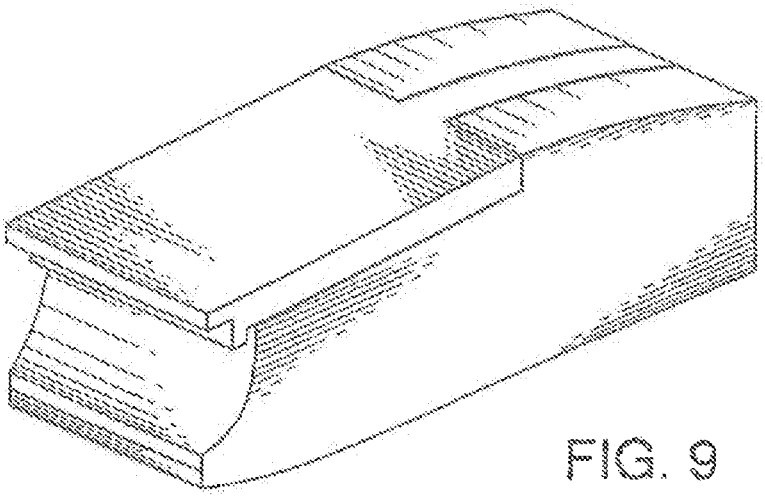
FIG. 9 is a perspective view of a container of the present invention in the closed position.

FIG. 9 shows the assembly in the closed position. It will be readily appreciated that the assembly is relatively compact, and will fit within a purse, handbag, or pocket, without taking up an undesired amount of space.

FIGS. 12A-12N show various views of another embodiment of a container assembly. Features of this embodiment are similar to the features of the embodiment depicted in FIGS. 6-9, with some differences as described here. The shape of the opening is asymmetrical. Also, the cover component 102 has a two hinge arrangement. Hinge 106 is as described above. Hinge 206 joins the first and second lid portions 104A and 104B. The lip of the lid portion is located on component 104B. Lid portion 104B is provided with tabs 208 that depend downward therefrom. Tabs 208 are sized and positioned to be received in recess 210 located on the top wall 109, and are received therein when the lid portion 104B is closed upon the top wall 109. In one embodiment, lid portion 104B may never be opened again, once it has been closed as described herein. The lid portion 104A is opened and shut at hinge 206.

Figure 13B:
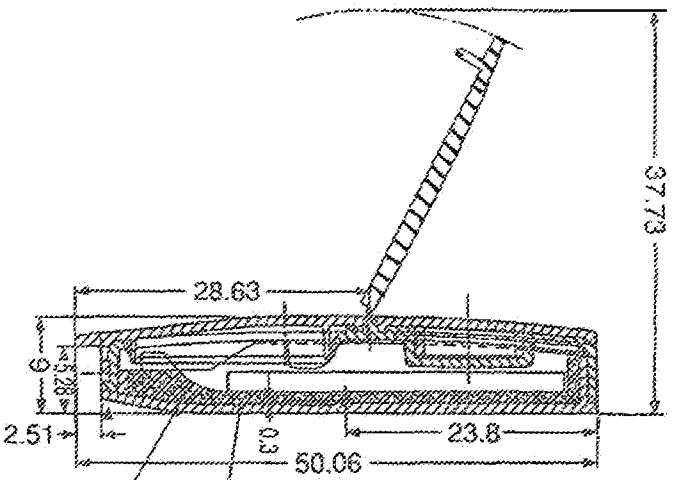
FIGS. 13A to 13E illustrate views of yet another embodiment of the present Invention.
Figure 13C:
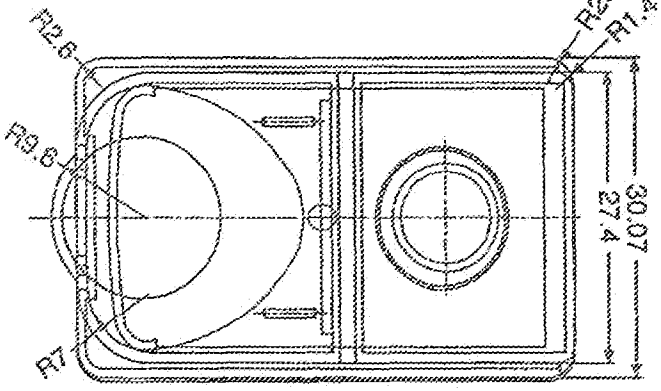
Figure 13A:
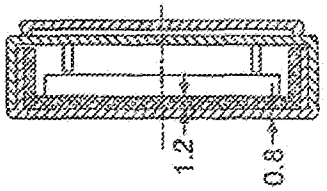
Figure 13E:
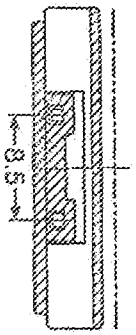
Figure 13D:
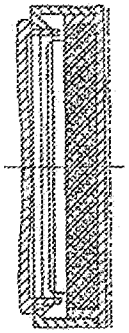

FIGS. 13A-12E show various views of yet another embodiment of a container assembly. Features of this embodiment are similar to the features of the embodiment depicted in FIGS. 1-5 and 6-9. As shown, the shape of the opening is asymmetrical. Also, the lid component has a one hinge arrangement. The hinge joins the lid to a portion of the container. In use, the lid portion is opened and shut at the hinge with the lid. In one example of constructing the assembly, the container base is made of two materials—at least a portion of the interior of the base is composed of a desiccant entrained plastic and the remaining portion of the base is composed of a substantially water impermeable plastic (e.g. polypropylene, polyethylene), The lid is welded (e.g. ultrasonic welding) to the lid portion. After the container is filled with the desired material, the lid is joined to container (e.g. ultrasonic welding). The result is a moisture tight container.

At least some or all of the embodiments of the present invention can be molded according to techniques disclosed in U.S. Pat. Re. 37,676 (a reissue of U.S. Pat. No. 5,723,085), U.S. Pat. Nos. 4,812,116, and 4,783,056, all of which are incorporated herein by reference.

In another embodiment, the present invention relates to moisture-tight and resealable container and lid assembly. The term "resealable" means that the lid of the container can be opened/reopened and closed/reclosed a numerous amount of times (e.g. more than 10 times) and still retain its moisture-tight properties. As used herein, the terms "moisture-tight" and "moisture-sensitive" mean the moisture ingress of the container (after three days) was less than about 1500 micrograms of water, in another embodiment, about 500 micrograms of water, in a further embodiment, about 300 micrograms of water, in yet another embodiment, about 150 micrograms of water determined by the following test method: (a) place one gram plus or minus 0.25 grams of molecular sieve in the container and record the weight; (b) fully close the container; (c) place the closed container in an environmental chamber at conditions of 80% relative humidity and 72 F: (c) after one day, weigh the container containing the molecular sieve; (d) after four days, weigh the container containing the molecular sieve; and (e) subtract the first day sample from the fourth day sample to calculate the moisture ingress of the container in units of micrograms of water.

What is claimed is:

1. A method of making a resealable container and lid assembly for storing and packaging moisture-sensitive items, the method comprising:

a) injection molding a container and a lid, the container having a container base and a sidewall extending upwardly from the container base;

i) a top of the container having an opening that permits access to an interior of the container;

ii) the opening being spaced away from an outer surface of the sidewall of the container by at least a portion of the thickness of the sidewall of the container;

iii) the lid being attached by a hinge to the container, the lid being movable about the hinge from an opened position to a closed position, the lid having an outer periphery that extends over at least a portion of the container, the lid having a skirt that extends downwardly therefrom, the lid having an underside;

iv) the skirt of the lid being positioned at a location on the lid that allows the skirt of the lid to close over the top of the container, wherein the skirt of the lid fits over a periphery the top of the container;

wherein the skirt of the lid includes an inwardly facing rounded extension, a lip of the top of the container includes an outwardly facing rounded extension, the inwardly facing rounded extension of the skirt of the lid and the outwardly facing rounded extension of the lip abut and interlock with each other when the lid is in the closed position and wherein a space is provided between the lip and the underside of the lid when the lid is in the closed position;

v) the lid further including a flexible lip seal member that extends downwardly therefrom to a position below where the extensions abut and interlock when the lid is in the closed position, the flexible lip seal member of the lid being configured to abut at least a portion of an interior of the sidewall of the container when the lid is in the closed position;

wherein the flexible lip seal member is configured to deflect to provide a sealing position, when the skirt of the lid is closed over the top container; and b) injection molding a desiccant entrained polymer sleeve or liner; and c) inserting the desiccant entrained polymer sleeve or liner into the container body.

2. The method of claim 1, wherein the moisture-sensitive items are diagnostic test strips.

3. The method of claim 2, further comprising:

d) inserting the diagnostic test strips into the container body.

4. The method of claim 1, wherein step c) further comprising press-fitting the desiccant entrained polymer insert or liner into the container.

5. The method of claim 1, wherein the outwardly facing rounded extension projects around the periphery of the lip.

6. The method of claim 1, wherein a moisture ingress of the container, after three days, is less than about 1500 micrograms of water.

7. The method of claim 1, wherein a moisture ingress of the container, after three days, is less than about 500 micrograms of water.

8. The method of claim 1, wherein a moisture ingress of the container, after three days, is less than about 300 micrograms of water.

* * * * *